United States Patent [19]

Lecklider

[11] Patent Number: 4,599,496

[45] Date of Patent: Jul. 8, 1986

[54] VARIABLE CONTROL DEVICE

[76] Inventor: Thomas H. Lecklider, 27 Farmadine, Saffron Walden, Essex, England, CB113HR

[21] Appl. No.: 673,701

[22] PCT Filed: Feb. 10, 1984

[86] PCT No.: PCT/GB84/00036

§ 371 Date: Oct. 9, 1984

§ 102(e) Date: Oct. 9, 1984

[87] PCT Pub. No.: WO84/03172

PCT Pub. Date: Aug. 16, 1984

[30] Foreign Application Priority Data

Feb. 10, 1983 [GB] United Kingdom ..... 8303679

[51] Int. Cl.[4] ..... H01H 13/64; H01H 1/06

[52] U.S. Cl. ..... 200/1 B; 200/16 A; 200/275

[58] Field of Search ..... 200/1 B, 5 R, 5 A, 16 A, 200/16 C, 16 D, 67 DA, 67 DB, 159 R, 159 B, 243, 264, 265, 275, 276, 292, 1–18, 159; 361/288

[56] References Cited

U.S. PATENT DOCUMENTS

| | | | |
|---|---|---|---|
| 3,488,460 | 1/1970 | Baumanis | 200/275 X |
| 3,693,059 | 9/1972 | Harris | 361/288 |
| 3,696,408 | 10/1972 | Bouchard et al. | 200/264 X |
| 3,898,421 | 8/1975 | Suzumura | 200/5 A X |
| 3,911,233 | 10/1975 | Nakamura et al. | 200/264 X |
| 3,973,099 | 8/1976 | Morris, Sr. | 200/264 X |
| 3,987,259 | 10/1976 | Larson | 200/5 A |
| 3,996,429 | 12/1976 | Chu et al. | 200/67 DB X |
| 4,035,594 | 7/1977 | McKinney et al. | 200/16 D |
| 4,242,546 | 12/1980 | Alonso | 200/264 X |
| 4,349,712 | 9/1982 | Michalski | 200/5 A X |
| 4,362,911 | 12/1982 | Sears et al. | 200/5 A |
| 4,376,238 | 3/1983 | Martin | 200/1 B X |

FOREIGN PATENT DOCUMENTS

| | | | |
|---|---|---|---|
| 2189848 | 1/1974 | France . | |
| 2196515 | 3/1974 | France . | |
| 804979 | 11/1958 | United Kingdom | 200/276 |

*Primary Examiner*—J. R. Scott

*Attorney, Agent, or Firm*—Jeannette M. Walder; G. Paul Edgell; Edward E. Sachs

[57] ABSTRACT

A variable control device comprises a manually operable member (5) arranged to be moved in a first direction (A) by an operator. A substrate (2) is provided with a plurality of contacts (4) spaced apart in a plane transverse to the first direction. A further member (6) is disposed between the manually operable portion (5) and substrate (2), The further member (6) is provided with a conductive surface facing the substrate (2). Movement of the manually operable portion (5) in the first direction (A) causes deformation of the further member (6). Contacts 4 on the substrate are progressively bridged by the further member conductive surface as deformation of the further member (6) increases.

1 Claim, 6 Drawing Figures

VARIABLE CONTROL DEVICE

BACKGROUND OF THE INVENTION

The present invention relates to a manually operable variable control device.

It is known that control devices capable of varying the range of shift of a parameter are usually in the form of a rotary switch or potentiometer. These devices are physically large and in some cases the design of the devices only permits two or three selectable positions.

SUMMARY OF THE INVENTION

The present invention provides a variable control device comprising a manually operable member arranged to be moved in a first direction by an operator, a substrate provided with a plurality of contacts spaced apart in a plane transverse to said first direction, and a further member disposed between the manually operable portion and substrate, one of the further member and substrate being deformable and said further member being provided with a conductive surface facing the substrate whereby upon movement of the manually operable member in said first direction a progressively greater number of contacts are bridged by the conductive surface provided on the further member due to relative deformation between the further member and the substrate.

The present invention comprises a variable control device which resembles a push-button. There is a functional relationship between the output of the device and the degree to which the device is pressed.

BRIEF DESCRIPTION OF THE DRAWINGS

Features and advantages of the present invention will become apparent from the following description of embodiments thereof when taken in conjunction with the accompanying drawings, in which:

FIGS. 2*a* and 2*b* show a second embodiment of a control device according to the present invention in which FIG. 2*a* shows the neutral position and FIG. 2*b* shows the depressed position; and FIGS. 3*a* and 3*b* show a further embodiment of a control device according to the present invention in which FIG. 3*a* shows the neutral positon and FIG. 3*b* shows the depressed position.

DESCRIPTION OF THE PREFERRED EMBODIMENTS

According to the embodiments of the present invention, there is provided a plurality of switch contacts which close in a successive sequence in response to increased pressure on a deformable member. The relationship between the pressure required to close a switch is not necessarily linearly related to the position of a switch in the sequence. It may require much more pressure to close a particular switch in the sequence of switches than it did to close the immediately previous switch.

Figure 1A:
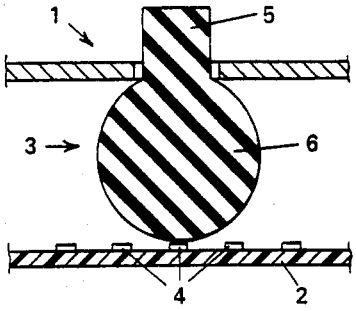
FIGS. 1*a* and 1*b* show a first embodiment of the present invention with FIG. 1*a* showing the neutral position and FIG. 1*b* the depressed position.
Figure 1B:
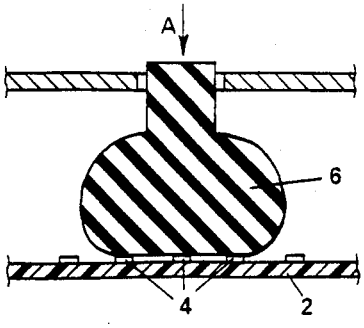

As shown in FIGS. 1*a* and 1*b*, a control device generally indicated by the reference numeral 1 comprises a resilient member 3 and a number of spaced and electrically separate conductors 4 located opposite the member 3 on a circuit board 2 or other rigid insulating member. The conductors are in the form of spaced parallel tracks which for convenience are printed on the substrate and extend in a plane transverse to the direction of movement of the key position 5. The resilient member 3 in this embodiment is shaped to provide a manually operable key portion 5 and a bulbous contact-making portion 6. At least the portion 6 is made of or has its surface provided with a conductive elastomeric material which can be deformed by pressure such as can be applied by one finger.

One of the conductors 4, preferably the centre conductor, is used as a common conductor and is in contact with the member 3 when in the neutral position as shown in FIG. 1*a*. In use, an operator applies pressure to the key portion 5 in the direction of the arrow A which causes the portion 6 to deform and flatten as shown in FIG. 1*b* in directions at right angles to the direction of pressure so as to increase the number of conductors 4 contacted by the portion 6.

When the control device 1 is in use in a micro-processor controlled apparatus, for example, the individual conductors 4 can be scanned by the micro-processor in the same way as it would scan a conventional keyboard. Alternatively, in the case of a plurality of control devices 1 each having a common centre conductor the corresponding individual conductors 4 may be bussed together but not the common centre conductors and the micro-processor can then scan the bus tracks and the common conductors.

Figure 2A:
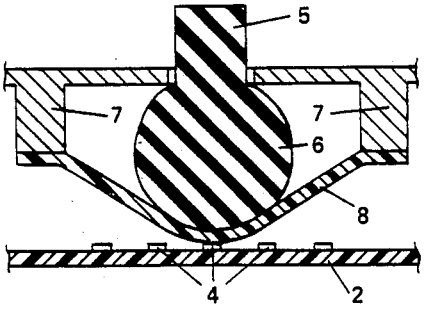
Figure 2B:
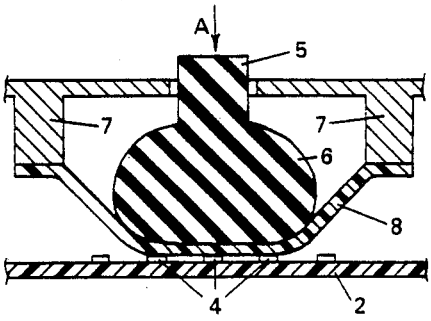

According to another embodiment of the present invention noting FIGS. 2*a* and 2*b*, the member 3 is one piece member made of a non-conductive elastomer and the device includes a layer of conductive material which in this case is a layer of elastomeric material 8 stretched between supports 7 on the inner surface of a housing of the device between the portion 6 and the conductors 4 such that on progressively depressing the key portion 5 the increase in pressure causes the layer 8 to progressively spread over the conductors 4 as shown in FIG. 2*b* and in a similar manner to the bulbous portion 6 in FIG. 1*b*.

Figure 3A:
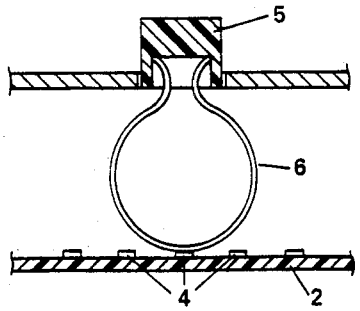
Figure 3B:
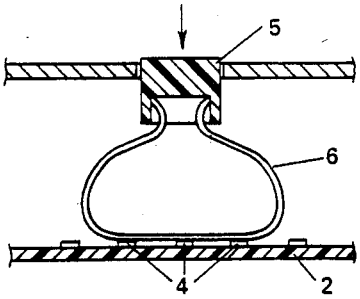

Alternatively, as shown in FIGS. 3*a* and 3*b*, instead of using a one-part member 3, the parts 5 and 6 can be made of different materials and in this case the portion 6 consists of a metal spring capable of being flattened in a similar way to the elastomeric portion 6 of the previous two embodiments when the key portion 5 is depressed. The key portion 5 may be a conventional plastics key or any other suitable form of key. In this instance, the portion 6 is a strip of metal formed into the appropriate shape by having its ends located in the key position 5 to form a resiliently deformable cylindrical portion intermediate its ends.

The above embodiments may be used on any one of a number of instruments and for any one of a number of functions, for example on a micro-processor control oscilloscope, where pressing the control device causes an on-screen cursor to move faster or to make items in a roll-round list change more quickly. The control device is thus capable of varying the speed where the degree of speed is proportional to the amount the control device is pressed, giving the user good "feel" when using the instrument.

Although the term 'bulbous' has been used in relation to the portion 6 in FIGS. 1*a*, 1*b*, 2*a* and 2*b* in order to describe a substantially spherical member, it will be understood that a substantially cylindrical member could be used such as the spring member shown in FIGS. 3*a* and 3*b*.

Further, although it is convenient to use a rigid substrate 2 and a deformable portion 6 on the key portion 5 it is also possible to achieve the same result by having a rigid portion 6 and a deformable substrate 2 or a combination of the two.

Although in FIGS. 1*a* and 1*b* the bulbous portion 6 of the member 3 contacts one of the conductors 4 when in the neutral position, this is not in fact essential. The portion 6 may, in all embodiments, be spaced from all the conductors 4 when in the neutral position. Further, there is no need for the conductors to be bridged in any particular order; the electric circuitry connected to the device can evaluate which contacts are bridged and take appropriate action.

I claim:

1. A variable control device comprising:

a manually operable member moveable in a first direction, a substrate provided with a plurality of contacts spaced apart in a plane transverse to said first direction, a further member disposed between the manually operable member and the substrate, the further member being resiliently deformable in response to pressure being applied to the manually operable member in the first direction, the manually operable member and the further member being formed of a single resilient member shaped to provide the manually operable member as a key portion and the further member as a bulbous contact-making portion, the further member being provided with a conductive surface facing the substrate and having a substantially cylindrical cross-section when viewed in a direction transverse to the first direction, the conductive surface progressively bridging the contacts in the substrate in response to deformation of the further member such that the output produced by the number of contacts bridged increases with an increase in pressure to the manually operable member.

* * * * *